US007546053B2

(12) United States Patent
Yamada

(10) Patent No.: US 7,546,053 B2
(45) Date of Patent: Jun. 9, 2009

(54) IMAGE FORMING APPARATUS AND CONTROL METHOD FOR THE SAME

(75) Inventor: Ayako Yamada, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 152 days.

(21) Appl. No.: 11/679,002

(22) Filed: Feb. 26, 2007

(65) Prior Publication Data

US 2007/0228648 A1 Oct. 4, 2007

(30) Foreign Application Priority Data

Mar. 31, 2006 (JP) ..... 2006-098526

(51) Int. Cl.
*G03G 15/00* (2006.01)
*G03G 21/14* (2006.01)

(52) U.S. Cl. ..... 399/75; 399/43; 399/405

(58) Field of Classification Search ..... 399/75, 399/43, 38, 405, 407, 397
See application file for complete search history.

(56) References Cited

U.S. PATENT DOCUMENTS 6,282,387 B1 8/2001 Yamada
7,251,424 B2 * 7/2007 Yoshizawa ..... 399/407 X
7,349,645 B2 * 3/2008 Ohnishi et al. ..... 399/405 X

FOREIGN PATENT DOCUMENTS

JP 08-202098 8/1996
JP 2001-282074 10/2001

* cited by examiner

*Primary Examiner*—Sophia S Chen
(74) *Attorney, Agent, or Firm*—Turocy & Watson, LLP

(57) ABSTRACT

An image forming apparatus for discharging a sheet from a discharge port to a sheet tray, includes a main unit provided with a discharge port and movably provided with a sheet tray to hold the sheet discharged from the discharge port, a drive unit to start movement of the sheet tray toward a position of the discharge port on the basis of an instruction of image forming start, and an image forming unit to compare sheet tray movement time which is time required for the sheet tray to reach the discharge port by the drive unit with image formation processing time which is time of an image forming process performed before discharging the sheet from the discharge port and when the sheet tray movement time does not exceed the image formation processing time, to start the image forming process.

24 Claims, 6 Drawing Sheets

SHEET TRAY MOVEMENT TIME TABLE

| CURRENT POSITION | SELECTED SHEET TRAY | MOVEMENT TIME (sec) |
|---|---|---|
| A | A | 0 |
| A | B | x |
| B | A | y |
| B | B | 0 |

0 : ZERO

FIG. 4A

IMAGE FORMATION PROCESSING TIME TABLE

| PAPER SIZE | PROCESSING TIME(sec) |
|---|---|
| A3 | AS |
| A4 | BS |
| B5 | CS |

| IMAGE DATA PROCESS | PROCESSING TIME(sec) |
|---|---|
| PERFORMED | P |
| NOT PERFORMED | Q |

| STAPLING | PROCESSING TIME(sec) |
|---|---|
| PERFORMED AT 2 PLACES | $\alpha$ |
| PERFORMED AT 1 PLACES | $\beta$ |
| NOT PERFORMED | $\gamma$ |

FIG. 4B

IMAGE FORMING APPARATUS AND CONTROL METHOD FOR THE SAME

CROSS-REFERENCE TO RELATED APPLICATION

This application is based upon and claims the benefit of priority from the prior Japanese Patent Application No. 2006-98526 filed on Mar. 31, 2006, the entire contents of which are incorporated herein by reference.

BACKGROUND

1. Field of the Invention

The present invention relates to an image forming apparatus aiming at speed-up of a process and a control method for the image forming apparatus.

2. Description of the Related Art

The operation of an image forming process of an MFP (Multi Function Peripheral) which is a conventional image forming apparatus will be explained.

FIG. 1 is a flow chart showing an example of the operation of the image forming process of a conventional MFP. Here, the image forming process when performing double-side print will be explained. The control unit of the MFP, upon receipt of an instruction (the start button is pressed) of image forming process setting and image forming process start from a user, executes this flow. Firstly, the control unit supplies a sheet from a cassette to an image forming unit, conveys the sheet with an image formed one side thereof by the image forming unit to an ADU (Auto Duplex Unit) (S112), and furthermore, after conveying the sheet, stops the sheet by an aligning roller (S113).

Next, the control unit judges whether the sheet tray selected as a discharge destination of the image forming process is the same as the sheet tray in use now as a discharge destination of the just prior image forming process or not (S121). When the selected sheet tray is the same as the sheet tray in use now (YES at S121), the control unit goes to Step S131. On the other hand, when the selected sheet tray is different from the sheet tray in use now (NO at S121), the control unit moves the selected sheet tray (S122).

Next, the control unit judges whether the movement of the selected sheet tray is completed or not (S131). When the movement is not completed (NO at S131), the control unit repeats Step S131. On the other hand, when the movement is completed (YES at S131), the control unit starts conveying of the sheet from the aligning roller to the image forming unit (S132). The sheet, after image forming by the image forming unit, is discharged to the selected sheet tray.

Further, as a prior art relating to the present invention, as indicated in Japanese Patent Application Publication No. 2001-282074, there is an image forming apparatus for controlling the timing of starting the operation of the image forming means according to the time required for the operation other than the image forming means and the time required for starting the image forming means.

However, as mentioned above, the control unit of the conventional MFP stops the sheet at the position of the aligning roller immediately before conveying it from the ADU to the image forming unit, moves the selected sheet tray, and at the point of time when the movement is completed, conveys the sheet to the image forming unit.

Namely, the sheet is stopped during movement of the sheet tray, so that the processing time of the MFP is increased.

SUMMARY

An object of the present invention is to provide an image forming apparatus for suppressing an increase in the processing time due to movement of a sheet tray and a control method for the image forming apparatus.

According to the embodiments of the present invention, there is provided an image forming apparatus for discharging a sheet from a discharge port to a sheet tray, comprising a main unit provided with a discharge port and movably provided with a sheet tray to hold the sheet discharged from the discharge port; a drive unit to start movement of the sheet tray toward a position of the discharge port on the basis of an instruction of image forming start; and an image forming unit to compare sheet tray movement time which is time required for the sheet tray to reach the discharge port by the drive unit with image formation processing time which is time of an image forming process performed before discharging the sheet from the discharge port and when the sheet tray movement time does not exceed the image formation processing time, to start the image forming process.

Furthermore, according to the embodiments of the present invention, there is provide an image forming apparatus for discharging a sheet from a discharge port to a sheet tray, comprising holding means provided movably on a main unit for holding the sheet discharged from the discharge port; drive means for starting movement of the holding means toward a position of the discharge port on the basis of an instruction of image forming start; and image forming means for comparing holding means movement time which is time required for the holding means to reach the discharge port by the drive means with image formation processing time which is time of an image forming process performed before discharging the sheet from the discharge port and when the holding means movement time does not exceed the image formation processing time, for starting the image forming process.

According to the embodiments of the present invention, there is provided a control method for an image forming apparatus for discharging a sheet from a discharge port to a sheet tray, comprising driving the sheet tray so as to start movement toward a position of the discharge port on the basis of an instruction of image forming start; and comparing sheet tray movement time which is time required for the driven sheet tray to reach the discharge port with image formation processing time which is time of an image forming process performed before discharging the sheet from the discharge port and when the sheet tray movement time does not exceed the image formation processing time, starting the image forming process.

BRIEF DESCRIPTION OF THE DRAWINGS

FIG. 4A is a table showing the sheet tray movement time;

FIG. 4B is a table showing the image formation processing time;

DETAILED DESCRIPTION OF THE EMBODIMENTS

Hereinafter, the embodiments of the present invention will be explained with reference to the accompanying drawings.

Firstly, the constitution of an MFP (Multi Function Peripheral) 10 relating to this embodiment will be explained.

Figure 1:
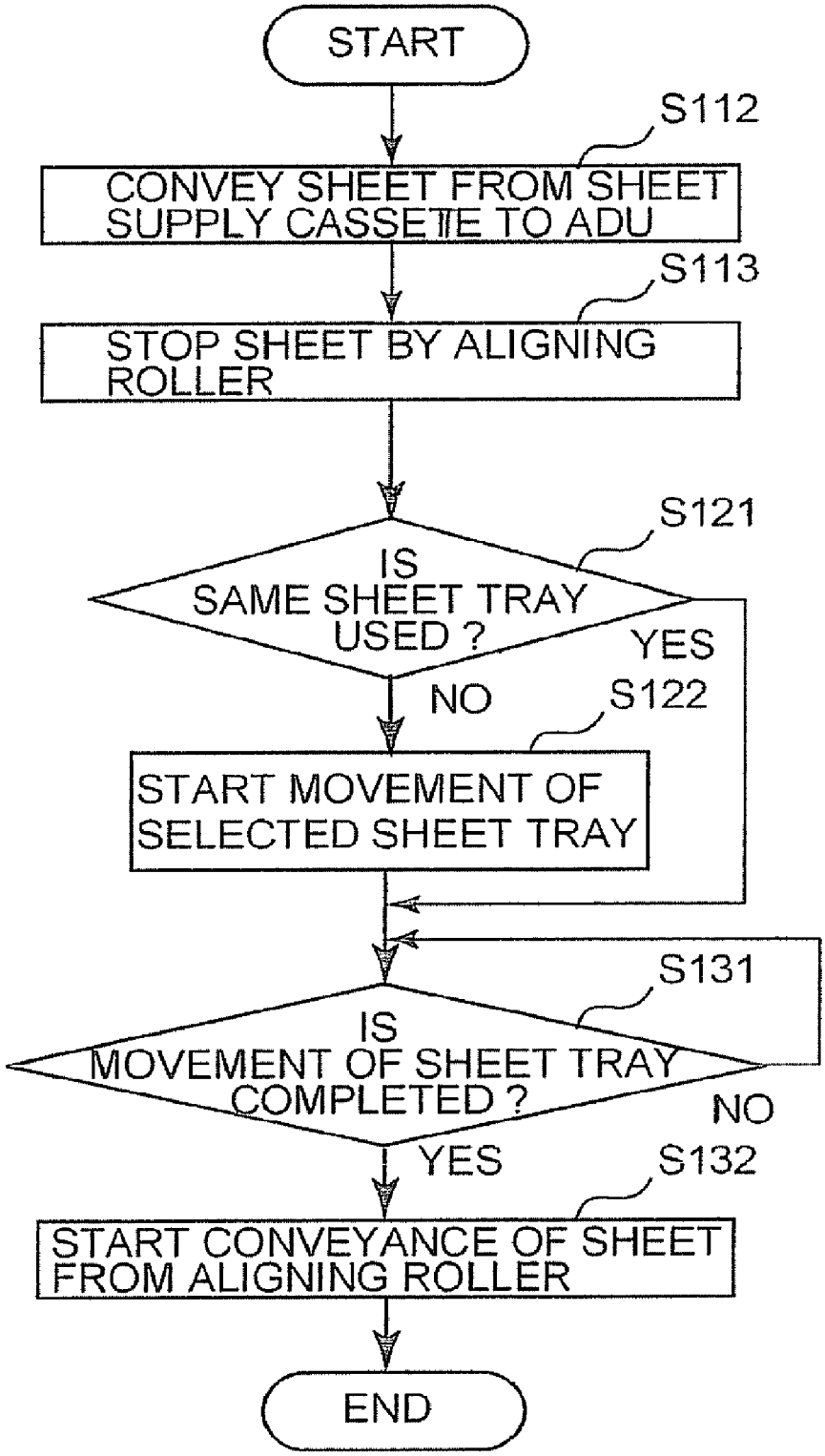
FIG. 1 (PRIOR ART)
FIG. 1 is a flow chart showing an example of the operation of the image forming process of the conventional MFP.
Figure 2:
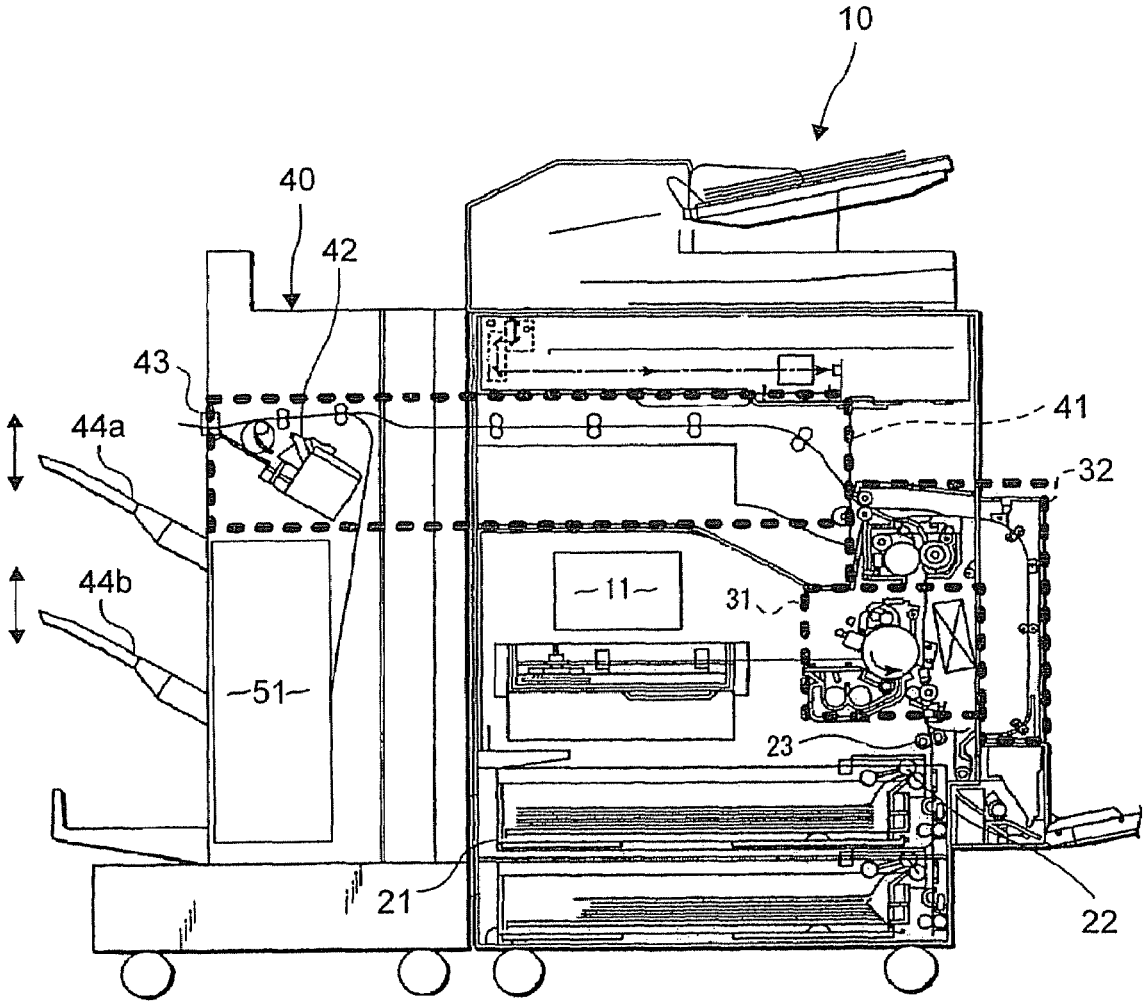
FIG. 2 is a schematic cross sectional view showing an example of the constitution of the MFP relating to the embodiments of the present invention.

FIG. 2 is a schematic cross sectional view showing an example of the constitution of the MFP 10 relating to this embodiment. The MFP 10 includes a control unit 11, a sheet supply cassette 21, a sheet supply roller 22, an aligning roller 23, an image forming unit 31, an ADU 32, a finisher 40, a discharge unit 41, a stapler 42, a discharge port 43, sheet trays 44*a* and 44*b* which are holding means for holding discharged sheets, and a sheet tray moving drive unit 51. The control unit 11 controls each unit of the MFP 10. The sheet tray moving drive unit 51 installed inside the finisher 40 moves the sheet tray selected by the control unit 11 among the sheet trays 44*a* and 44*b* to the discharge port 43.

Next, the route of sheets in the MFP 10 will be explained.

For example, when double-side print is set in the MFP 10, a sheet to be imaged is supplied from the sheet supply cassette 21 to the sheet supply roller 22 and is conveyed to the image forming unit 31 by the aligning roller 23. The sheet is imaged on the front surface by the image forming unit 31, is turned upside down by the ADU 32, and is conveyed again from the aligning roller 23 to the image forming unit 31. The sheet is imaged on the rear surface by the image forming unit 31, is discharged from the discharge port 43 by the discharge unit 41, and is held by the sheet tray 44*a*. Further, for example, when the stapling process is set in the MFP 10, the sheet imaged and conveyed to the discharge unit 41 is subject to the stapling process by the stapler 42. After the stapling process, the sheet is discharged from the discharge port 43 and is held by the sheet tray 44*a*. Further, the aligning roller 23 can keep the sheet stopped and the sheet conveyed from the aligning roller 23 to the image forming unit 31 cannot be stopped, thereby is discharged from the discharge port 43.

Next, the operation of the image forming process of the MFP will be explained.

Figure 3:
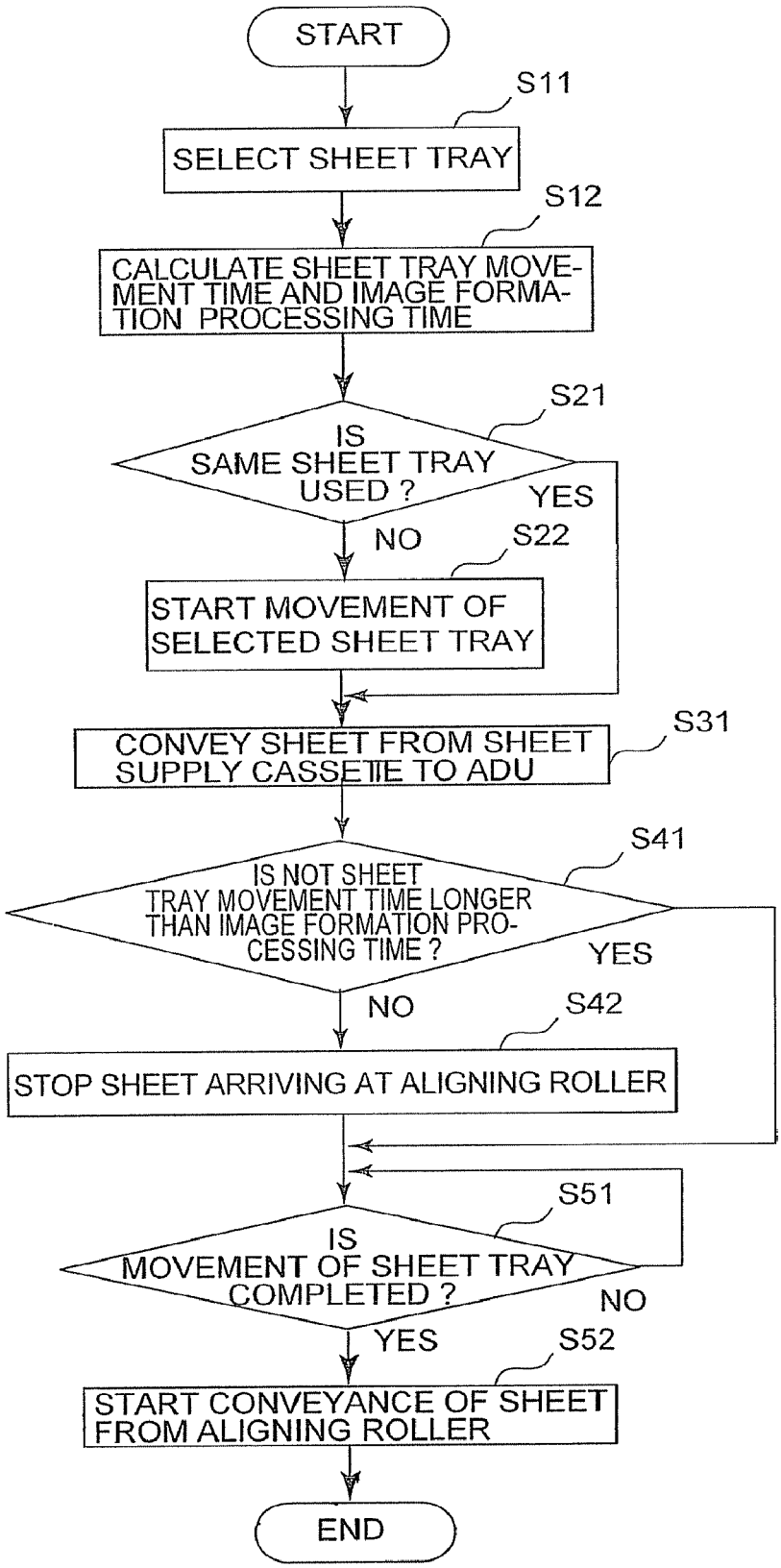
FIG. 3 is a flow chart showing an example of the operation of the image forming process of the MFP relating to a first embodiment of the present invention.

FIG. 3 is a flow chart showing an example of the operation of the image forming process of the MFP 10 relating to the first embodiment. The control unit 11, upon receipt of an instruction of setting of the image forming process and start of the image forming process (the start button is pressed), executes this flow. The control unit 11, on the basis of setting of the image forming process, selects the sheet tray (44*a* or 44*b*) to be used (S11). Here, the setting of the image forming process includes, for example, setting of single-side print or double-side print, sheet size, sheet thickness, setting of the image data process such as image quality correction or forming a plurality of images on one sheet, and setting of the stapling process. In this example, the setting of the image forming process is setting of double-side print.

Next, the control unit 11 calculates the time required for movement of the selected sheet tray from the current stop position to the discharge port 43 and assumes the calculated result as sheet tray movement time. Furthermore, the control unit 11 calculates the time required from the start of the image forming process to discharging of the sheet from the discharge port 43 on the basis of the setting of the image forming process and assumes the calculated result as image formation processing time (S12).

The control unit 11 includes a sheet tray movement time table (FIG. 4A) and an image formation processing time table (FIG. 4B).

In the sheet tray movement time table, the identification (ID) of the sheet tray (data indicating the discharge destination) and the sheet tray movement time corresponding to the current position are recorded beforehand. As shown in FIG. 4A, when the sheet tray is at the position A and the sheet tray A is selected, the time required for the sheet tray A to move to the discharge port 43 is zero second. When the sheet tray is at the position A and the sheet tray B is selected, the time required for the sheet tray B to move to the discharge port 43 is x seconds. When the sheet tray is at the position B and the sheet tray A is selected, the time required for the sheet tray B to move to the discharge port 43 is y seconds. When the sheet tray is at the position B and the sheet tray B is selected, the time required for, the sheet tray B to move to the discharge port 43 is zero second.

In the image formation processing time table, in correspondence to the setting of the image forming process, the image formation processing time is recorded beforehand. As shown in FIG. 4B, when the sheet size is A3, the time required for processing is AS seconds. When the sheet size is A4, the time required for processing is BS seconds. When the sheet size is B5, the time required for processing is CS seconds. When the process is required for the image data, the processing time is P seconds. When no process is required, the processing time is Q seconds. When executing stapling at two places, the processing time is a seconds. When executing stapling at one place, the processing time is .beta. seconds. When executing no stapling, the processing time is .gamma. seconds.

At Step S12, the control 11 obtains the ID of the sheet tray and the sheet tray movement time corresponding to the current position from the sheet tray movement time table. Further, the control 11 obtains the time of the image forming process corresponding to the setting of the image forming process from the image formation processing time table. Further, the sheet tray movement time may be calculated by the ID of the sheet tray, the current position, and a predetermined calculation formula. Further, the image formation processing time may be calculated using the calculation formula for totaling the processing time included in the image forming process on the basis of the setting of the image forming process.

Next, the control unit 11 judges whether the sheet tray (44*a* or 44*b*) selected at Step S11 is the same as the sheet tray 44*a* in use now as a discharge destination of the just prior image forming process or not (S21). When the selected sheet tray is the same as the sheet tray 44*a* in use now (YES at S21), the control unit 11 goes to Step S31. On the other hand, when the selected sheet tray is the sheet tray 44*b* different from the sheet tray 44*a* in use now (NO at S21), the control unit 11 makes the sheet tray moving drive unit 51 start movement of the selected sheet tray 44*b* (S22).

Next, the control unit 11, according to the route aforementioned, supplies the sheet to the image forming unit 31 from the sheet supply cassette 21 by the sheet supply roller 22 and conveys the sheet one side of which is printed by the image forming unit 31 to the ADU 32 (S31).

Next, the control unit 11 judges whether the sheet tray movement time calculated at Step S12 exceeds the image formation processing time calculated or not (S41). When the sheet tray movement time does not exceed the image formation processing time (YES at S41), the control unit 11 goes to Step S51. On the other hand, when the sheet tray movement time exceeds the image formation processing time (NO at S41), the control unit 11 stops the sheet arriving at the aligning roller 23 (S42).

Next, the control unit 11 judges whether the movement of the selected sheet tray 44*b* is completed or not (S51). When the movement is not completed (NO at S51), the control unit 11 repeats Step S51. On the other hand, when the movement is completed (YES at S51), the control unit 11 starts conveying of the sheet from the aligning roller 23 to the image forming unit 31 (S52). The sheet is conveyed to the selected sheet tray (44*a* or 44*b*) from the discharge port 43 via the image forming unit 31 and discharge unit 41 and the flow is finished.

Further, at Step S12, the control unit 11 further calculates the "sheet tray movement time—image formation processing time" as sheet stop time and instead of Step S51, may perform a process of calculating the time after arrival of the sheet at the aligning roller 23 and keeping the sheet stopped until this time reaches the sheet stop time.

Further, at Step S12, the control unit 11 may take the time required for the sheet to be conveyed from a place where the aligning roller 23 can stop to the discharge port 43 as image formation processing time and execute Step S41 at the point of time when the sheet arrives at the place.

In this embodiment, the case that setting of the image forming process is setting of double-side print is described. When setting of the image forming process is setting of single-side print, the necessary time of single-side print recorded beforehand in the image formation processing time table results in the image formation processing time. At this time, instead of Step S31, the control unit 11 performs a process of only supplying the sheet from the sheet supply cassette 21 by the sheet supply roller 22. Namely, the image formation processing time is less than that of double-side print by the processing time from the ADU 32 to the image forming unit 31.

Further, when adding another process to the image forming process, the necessary time of the process is included in the image formation processing time. For example, when setting of the image data process is included in setting of the image forming process, the necessary time of the image data process recorded beforehand in the image formation processing time table is included in the image formation processing time. Further, for example, when setting of the stapling process is included in setting of the image forming process, the necessary time of stapling recorded beforehand in the image formation processing time table is included in the image formation processing time.

According to this embodiment, the control unit 11, upon receipt of an instruction of start of the image forming process, starts immediately movement of the sheet tray and when the sheet tray movement time exceeds the image formation processing time, adjusts the conveying time of the sheet by the aligning roller, thereby can shorten the image formation processing time accompanied by the movement of the sheet tray.

Figure 5:
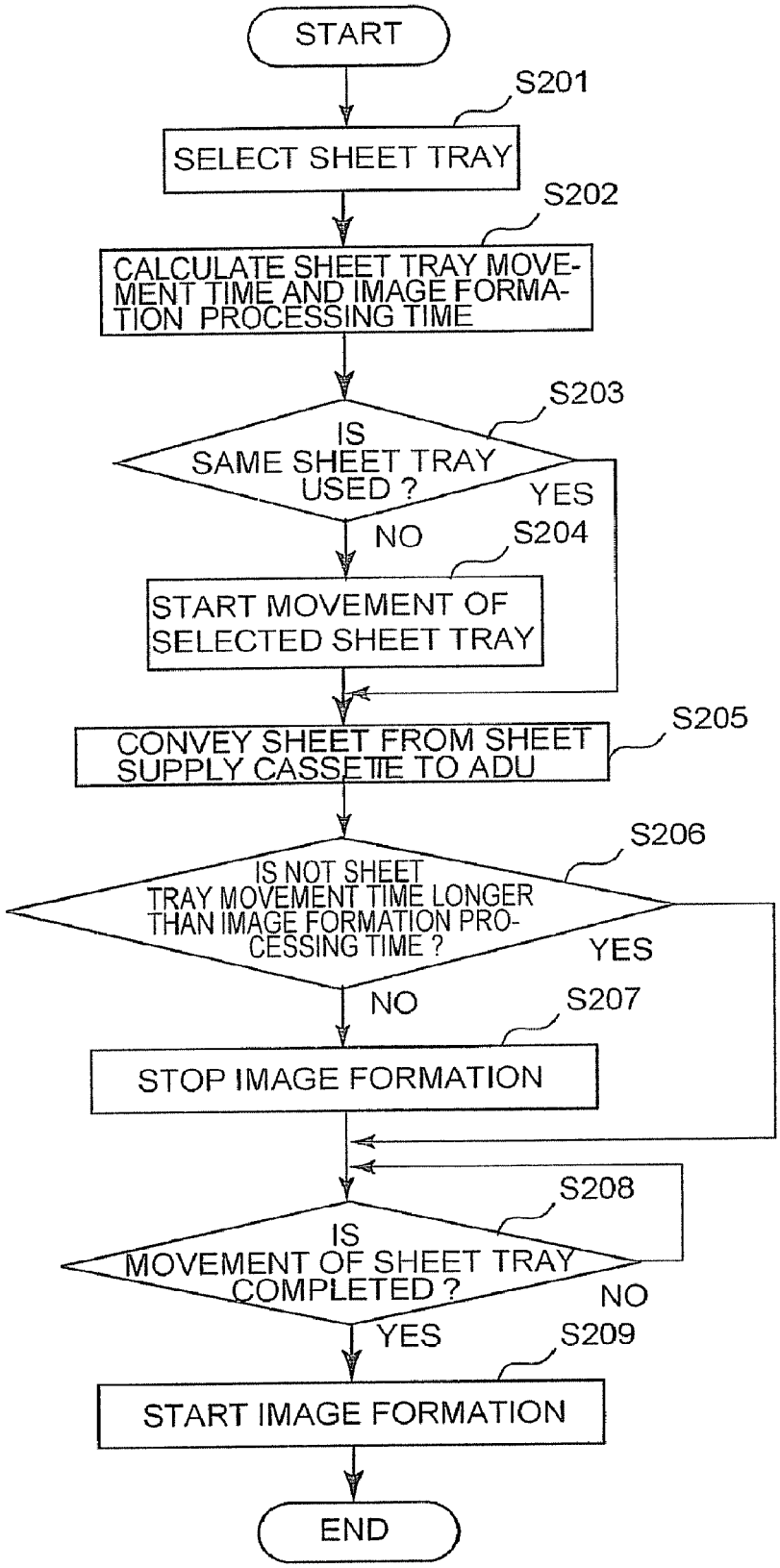
FIG. 5 is a flow chart showing an example of the operation of the image forming process of the MFP relating to a second embodiment of the present invention.

FIG. 5 is a flow chart showing an example of the operation of the image forming process of the MFP relating to the second embodiment.

Steps S201 to S206 shown in FIG. 5 are the same as Steps S11 to S41 shown in FIG. 3, so that the explanation thereof will be omitted. At Step S206, when it is judged that the sheet tray movement time exceeds the image formation processing time (NO at S206), the image formation is kept stopped (S207). Next, the control unit 11 judges whether the movement of the sheet tray is completed or not (S208). The control unit 11, when judging that the movement is not completed (NO at S208), repeats Step S208. The control unit 11, when judging that the movement of the sheet tray is completed (YES at S208), starts image formation (S209). Further, at Step S206, the control unit 11, when judging that the sheet tray movement time does not exceed the image formation processing time (YES at S206), starts image formation (S209).

Further, for calculation of the image formation processing time aforementioned, it is possible to obtain information of a mounting condition of an option, thereby change the calculation table.

Figure 6A:
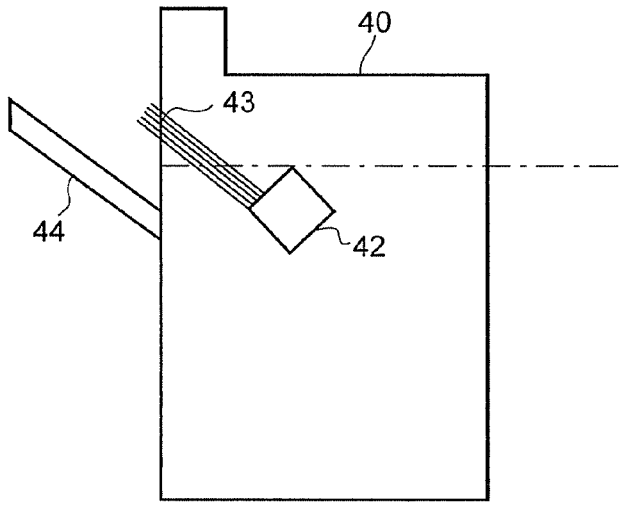
FIGS. 6A to 6C are respectively schematic views showing the relationship between the stapler position of the finisher and sheets different in size.

FIG. 6A shows a case that short sheets are used, which is a case that the finisher 40 is mounted optionally.

Figure 6B:
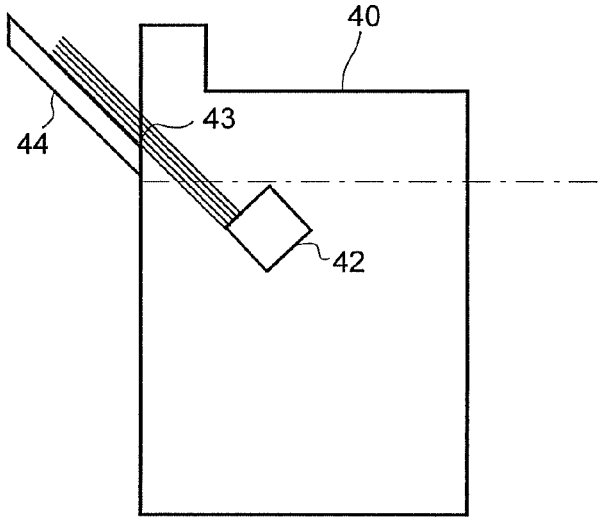

As shown in FIG. 6A, the distance from the stapler 42 to the discharge port 43 is slightly shorter than the length of the short sheets in the sheet conveying direction. Therefore, on the sheet tray 44, a plurality of sheets are all stacked and may be moved to the discharge port 43 before stapling them. However, as shown in FIG. 6B in which long sheets are used, when the distance from the stapler 42 to the discharge port 43 is considerably shorter than the length of the long sheets in the sheet conveying direction, unless the sheet tray 44 moves to the discharge port 43 before one sheet is stapled, it falls down. As mentioned above, the calculation of the image formation processing time is varied with the sheet length.

Figure 6C:
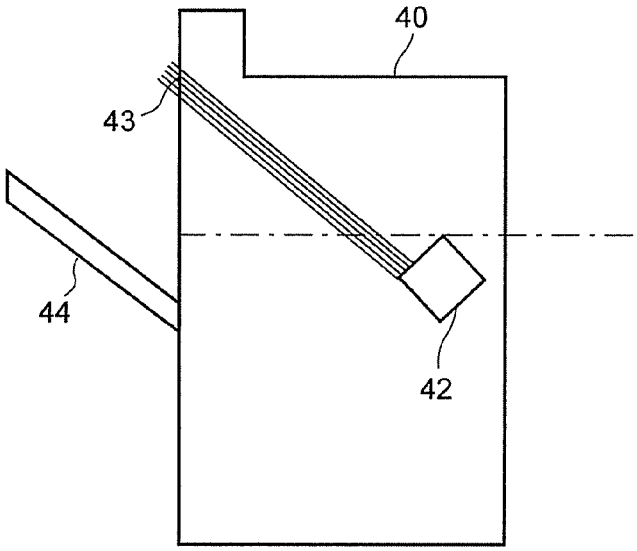

However, an option can be changed and it is assumed that as shown in FIG. 6C, the finisher 40 when the distance from the stapler 42 to the discharge port 43 is slightly shorter than the length of the long sheets in the sheet conveying direction is switched to the finisher 40 shown in FIGS. 6A and 6B. If this occurs, on the sheet tray 44, a plurality of sheets are all stacked and may be moved to the discharge port 43 before stapling them, and even if similarly long sheets are used, by use of the finisher 40, conveyance of the sheets arriving at the aligning roller can be started early, thus the throughput is improved.

Further, by use of the current position of the sheet tray to be used and the sheet tray movement time table, the sheet tray movement time can be calculated easily. Further, by use of the image formation processing time table, appropriate image formation processing time according to the process included in the setting of the image forming process can be calculated.

This embodiment is explained using the case that the functions for executing the invention are recorded beforehand in the apparatus. However, the present invention is not limited to it, and similar functions may be loaded down into the apparatus from the network, and a recording medium storing similar functions may be installed in the apparatus. As a recording medium, a recording medium which can store a program and can be read by the apparatus such as CD-ROM is acceptable regardless of its form. Further, the functions obtained beforehand by installation or down load like this may be realized in partnership with the operating system (OS) inside the apparatus.

Further, the sheet tray corresponds to the sheet trays 44*a* and 44*b* in the embodiments. Further, the sheet tray moving drive unit corresponds to the sheet tray moving drive unit 51 in the embodiments. Further, the image forming unit corresponds to the sheet supply cassette 21, sheet supply roller 22, aligning roller 23, image forming unit 31, ADU 32, discharge unit 41 and stapler 42 in the embodiments.

Further, the sheet tray moving drive step corresponds to Steps S21 and S22 in the embodiments. Further, the image forming step corresponds to Steps S41, S42, S51 and S52 in the embodiments.

According to the present invention, an increase in the processing time due to movement of the sheet tray can be suppressed.

What is claimed is:

1. An image forming apparatus for discharging a sheet from a discharge port to a sheet tray, comprising:

a main unit provided with a discharge port and movably provided with a sheet tray to hold the sheet discharged from the discharge port;

a drive unit to start movement of the sheet tray toward a position of the discharge port on the basis of an instruction of image forming start; and an image forming unit to compare sheet tray movement time which is time required for the sheet tray to reach the discharge port by the drive unit with image formation processing time which is time of an image forming process performed before discharging the sheet from the discharge port and when the sheet tray movement time does not exceed the image formation processing time, to start the image forming process, wherein the image forming unit, when the sheet tray movement time exceeds the image formation processing time, at a place closest to the discharge port, stops the sheet until a predetermined condition is satisfied.

2. The image forming apparatus according to claim 1, wherein the predetermined condition is that the sheet tray reaches the discharge port.

3. The image forming apparatus according to claim 1, wherein the predetermined condition is that the time for keeping the sheet stopped by the image forming unit is the "sheet tray movement time—image formation processing time".

4. The image forming apparatus according to claim 1, wherein the drive unit selects one sheet tray to be used from a plurality of sheet trays on the basis of the instruction and when the selected sheet tray is not arranged at the discharge port, judges that movement of the sheet tray is necessary.

5. The image forming apparatus according to claim 1, wherein the instruction of start includes setting of the image forming process and the image forming unit calculates the sheet tray movement time and the image formation processing time on the basis of the setting of the image forming process.

6. The image forming apparatus according to claim 5, wherein the image forming process includes single-side print or double-side print and furthermore can include a stapling process and an image data process according to the setting of the image forming process.

7. The image forming apparatus according to claim 1, wherein the instruction of start includes setting of the image forming process and the drive unit refers to a sheet tray movement time table on the basis of the setting of the image forming process, thereby drives the sheet tray and the image forming unit refers to an image formation processing time table on the basis of the setting of the image forming process, thereby executes the image forming process.

8. The image forming apparatus according to claim 7, wherein the image forming unit reads the image formation processing time from the image formation processing time table in correspondence to the setting of the image forming process.

9. The image forming apparatus according to claim 7, wherein the drive unit reads the sheet tray movement time from the sheet tray movement time table corresponding to a current position of the sheet tray.

10. An image forming apparatus for discharging a sheet from a discharge port to a sheet tray, comprising:

holding means provided movably on a main unit for holding the sheet discharged from the discharge port;

drive means for starting movement of the holding means toward a position of the discharge port on the basis of an instruction of image forming start; and image forming means for comparing holding means movement time which is time required for the holding means to reach the discharge port by the drive means with image formation processing time which is time of an image forming process performed before discharging the sheet from the discharge port and when the holding means movement time does not exceed the image formation processing time, for starting the image forming process, wherein the image forming means, when the holding means movement time exceeds the image formation processing time, at a place closest to the discharge port, stops the sheet until a predetermined condition is satisfied.

11. The image forming apparatus according to claim 10, wherein the predetermined condition is that the holding means reaches the discharge port.

12. The image forming apparatus according to claim 10, wherein the predetermined condition is that the time for keeping the sheet stopped by the image forming means is the "holding means movement time—image formation processing time".

13. The image forming apparatus according to claim 10, wherein the drive means selects one sheet tray to be used from a plurality of holding means on the basis of the instruction and when the selected holding means is not arranged at the discharge port, judges that movement of the holding means is necessary.

14. The image forming apparatus according to claim 10, wherein the instruction of start includes setting of the image forming process and the image forming means calculates the holding means movement time and the image formation processing time on the basis of the setting of the image forming process.

15. The image forming apparatus according to claim 14, wherein the image forming process includes single-side print or double-side print and furthermore can include a stapling process and an image data process according to the setting of the image forming process.

16. The image forming apparatus according to claim 10, wherein the instruction of start includes setting of the image forming process and the drive means refers to a holding means movement time table on the basis of the setting of the image forming process, thereby drives the holding means and the image forming means refers to an image formation processing time table on the basis of the setting of the image forming process, thereby executes the image forming process.

17. The image forming apparatus according to claim 16, wherein the image forming means reads the image formation processing time from the image formation processing time table in correspondence to the setting of the image forming process.

18. The image forming apparatus according to claim 16, wherein the drive means reads the holding means movement time from the holding means movement time table corresponding to a current position of the holding means.

19. A control method for an image forming apparatus for discharging a sheet from a discharge port to a sheet tray, comprising:

driving the sheet tray so as to start movement toward a position of the discharge port on the basis of an instruction of image forming start: and comparing sheet tray movement time which is time required for the driven sheet tray to reach the discharge port with image formation processing time which is time of an image forming process performed before discharging the sheet from the discharge port and when the sheet tray movement time does not exceed the image formation processing time, starting the image forming process, wherein when the sheet tray movement time exceeds the image formation processing time, at a place closest to the discharge port, the sheet is stopped until a predetermined condition is satisfied.

20. The control method for an image forming apparatus according to claim 19, wherein the predetermined condition is that the sheet tray reaches the discharge port.

21. The control method for an image forming apparatus according to claim 19, wherein the predetermined condition is that the time for keeping the sheet stopped is the "sheet tray movement time—image formation processing time".

22. The control method for an image forming apparatus according to claim 19, wherein one sheet tray to be used is selected from a plurality of sheet trays on the basis of the instruction and when the selected sheet tray is not arranged at the discharge port, it is judged that movement of the sheet tray is necessary.

23. The control method for an image forming apparatus according to claim 19, wherein the instruction of start includes setting of the image forming process and the sheet tray movement time and the image formation processing time are calculated on the basis of the setting of the image forming process.

24. The control method for an image forming apparatus according to claim 19, wherein the instruction of start includes setting of the image forming process, and a sheet tray movement time table is referred to on the basis of the setting of the image forming process, thus the sheet tray is driven, and an image formation processing time table is referred to on the basis of the setting of the image forming process, thus the image forming process is executed.

* * * * *